US008051789B1

(12) United States Patent
Tylisz

(10) Patent No.: US 8,051,789 B1
(45) Date of Patent: Nov. 8, 2011

(54) MOORING DEVICE

(75) Inventor: Thomas G. Tylisz, Tampa, FL (US)

(73) Assignee: Wang Anchor, Inc., Tampa, FL (US)

( * ) Notice: Subject to any disclaimer, the term of this patent is extended or adjusted under 35 U.S.C. 154(b) by 0 days.

(21) Appl. No.: 12/456,904

(22) Filed: Jun. 24, 2009

Related U.S. Application Data

(60) Provisional application No. 61/198,011, filed on Oct. 31, 2008.

(51) Int. Cl.
*B63B 21/00* (2006.01)

(52) U.S. Cl. ..... 114/230.1; 114/294; 114/221 R

(58) Field of Classification Search ..... 114/230.1, 114/230.14, 230.16, 294, 221 R; 440/36, 440/101
See application file for complete search history.

(56) References Cited

U.S. PATENT DOCUMENTS

| | | | | |
|---|---|---|---|---|
| 910,090 | A | 1/1909 | Schilling | |
| 1,164,361 | A | 12/1915 | Kilgore | |
| 2,293,130 | A | 8/1942 | Brodie | |
| 2,477,410 | A | 7/1949 | Johnson | |
| 2,787,795 | A | 4/1957 | Snodgrass | |
| 2,991,750 | A | 6/1961 | Tourneau | |
| 3,043,261 | A | 6/1962 | Snodgrass | |
| 3,048,139 | A | 8/1962 | Duckett | |
| 3,238,912 | A | 3/1966 | Perlick | |
| 3,693,569 | A | 9/1972 | Chauvin | |
| 3,799,099 | A | 3/1974 | Conover | |
| 4,121,531 | A | 10/1978 | Norton | |
| 5,116,260 | A * | 5/1992 | Upchurch | 114/221 R |
| 5,830,024 | A * | 11/1998 | Killen et al. | 440/101 |
| 6,145,717 | A | 11/2000 | Rebeck | |
| 6,168,480 | B1 | 1/2001 | Shaller | |
| 6,220,197 | B1 | 4/2001 | Pohlman | |
| 6,481,364 | B2 * | 11/2002 | Woyjeck | 114/294 |
| 6,739,275 | B2 * | 5/2004 | Darling et al. | 114/221 R |
| D519,820 | S | 5/2006 | Newman et al. | |
| 7,270,073 | B1 * | 9/2007 | Waldrop | 114/295 |
| 2009/0170382 | A1 * | 7/2009 | Cromartie | 440/36 |

* cited by examiner

*Primary Examiner* — Stephen Avila
(74) *Attorney, Agent, or Firm* — Frijouf, Rust & Pyle, P.A.

(57) ABSTRACT

A mooring device is disclosed for securing a floating structure to a layer of soil. A body of water is displaced by the vessel. The floating structure supports an individual having a first hand and a second hand. The mooring device comprises a shaft extending between a first end and a second end. A point is secured to the first end of the shaft for permitting the shaft to transverse the layer of soil. A handle is secured to the second end of the shaft for receiving a descending vertical force or an ascending vertical force. The handle includes a concave upper surface extending between a primary end and a secondary end for receiving the first hand and/or the second hand of the individual during the descending vertical force. The handle includes a first convex surface and a second convex surface.

10 Claims, 11 Drawing Sheets

MOORING DEVICE

CROSS-REFERENCE TO RELATED APPLICATIONS

This application claims benefit of U.S. Patent Provisional application Ser. No. 61/198,011 filed Oct. 31, 2008. All subject matter set forth in provisional application Ser. No. 61/198,011 is hereby incorporated by reference into the present application as if fully set forth herein.

BACKGROUND OF THE INVENTION

1. Field of the Invention

This invention relates to a mooring device and more particularly to the boat mooring device for securing a boat to a soil layer.

2. Background of the Invention

Mooring a vessel allows the vessel to remain stationary within a body of water. Many types of devices may be used for mooring a vessel to a fixed object, such as a pier. However, if the vessel is located in open waters, mooring the vessel may be troublesome. Furthermore, if the vessel is located within open swallow water and/or the vessel may be subject to within close proximity to the vessel resulting in further complications in mooring a vessel. Several attempts in the prior art have been made to provide a solution to mooring a vessel in swallow open water.

U.S. Pat. No. 910,090 to Schilling discloses a pushing pole for boats comprising a rod or pole, a spherical head and a hemispherical socket secured to the pole, and the head secured to the socket.

U.S. Pat. No. 1,164,361 to C. Kilgore discloses a kit for propelling water crafts comprising a jointed pole, a detachable collapsible head, and a pair of detachable paddle blades. The head and detachable paddle blades are interchangeably usable.

U.S. Pat. No. 2,293,130 to A. Brodie discloses a punting device comprises a socket, a pull out pin passing transversely through the socket. A pair of blades are pivotally carried by the extended ends of the pin and centrally notched to escape the socket and permit of the up and down swinging of the blades. Stop means are carried by the socket and engagable with the blades to arrest them in a position substantially t right angles to the socket.

U.S. Pat. No. 2,477,410 to R. Johnson discloses a combination of an elongated shaft, one end of which constitutes a handle, a reinforcing cap secured to the opposite end having a hook portion thereon extending rearwardly towards the handle. A pair of paddle vanes are carried by the shaft and extend outwardly from opposite sides of the shaft, intermediate the handle and capped end thereof. The vanes are positioned substantially in a common plane, the hook portion lying substantially in the plane of the vanes. The end edges of the latter are adjacent the capped end of the shaft are inclined outwardly and rearwardly towards the handle end thereof.

U.S. Pat. No. 2,787,795 to G. Snodgrass discloses a punting pole for pushing a boat through waters having vegetable growths such as wild rice, including a handle and a head attached to one end of the handle. The head has a pair of rigid arms forkedly extending from the end of the pole in the same plane but in symmetrical opposition and adapted to embrace and gather into a clump a plurality of plants as the forked end is pushed against the plants.

U.S. Pat. No. 2,991,750 to R. Tourneau discloses an apparatus for aiding a ship to move on or off a beach. The apparatus comprises a pair pusher members each in the form of a rigid beam having gear teeth extending longitudinally thereof, and having an enlarged foot portion at each end thereof. A pair of gear reductions each have an output shaft with an output pinion fixed to the shaft. The gear reductions are fixed to the ship at opposite sides thereof with their respective output shafts extended outwardly from the ships side. A carriage journalled is on each of the output shaft. Each carriage includes means for supporting a respective pusher member beneath the respective output shaft for longitudinal reciprocal movement. The output pinion engages the gear teeth of the respective pusher member. Means drive the gear reductions to control the longitudinal position of the respective pusher members.

U.S. Pat. No. 3,043,261 to G. Snodgraass discloses a punting pole for pushing a boat through shallow water comprising an elongated handle and a head secured to one end of the handle. The head comprises a ferrule for receiving the end of the handle. A fork on the forward end of the ferrule provided by forwardly and outwardly extending divergent arms disposed in a common plane substantially coinciding with and parallel to the longitudinal axis of the handle. The inner surfaces of the arms provide a flat continuous surface having an arcuate central portion merging into a straight flat portion on each arm extending outwardly and forwardly at an angle to the axis of the handle. Each straight portion merges into a curved portion terminating at the end of each arm. A tangent to the curved portion at the end of each arm is substantially parallel to the axis of the handle. The width of the straight flat portions are substantially less than the width of the central arcuate portion and flare outwardly to the ends of the curved portions. Whereby the width of the ends of the curved portions are substantially greater than the width of the arcuate central portion.

U.S. Pat. No. 3,048,139 to J. Duckett discloses a boat hook and docking device which comprises a shaft and a head secured to an outer end of the shaft. The head has spaced outwardly extending prongs thereon ending in surface engaging tips and defining a yoke opening in an outward direction from the shaft and in the same general direction as the axis of the shaft. The configuration of the yoke is such to except a right angle, while the surface engaging tips contact the sides of the right angle without contact between the yoke and the apex of the right angle as long as the angle between a line along the axis of the shaft and a line bisecting a right angle is between zero and about 30 degrees on either side of zero. An inwardly extending prong on the head defines a hook opening in an inward direction along the shaft. The depth of the hook opening along a line parallel to the axis of the shaft is more than one half the width of the opening taken along a line from the tip of the inwardly extending prong perpendicular to the axis of the shaft.

U.S. Pat. No. 3,238,912 to S. Perlick discloses a boat floatingly supported on the surface of a natural body of water, at least two posts are located on opposite sides of the boat and adapted to be vertically imbedded in the floor of the water body with their upper ends extending above the upper sides of the boat. Each of the posts have a clamping means secured thereto and to the boat. Each of the clamping means comprises a sleeve at least partially surrounding the post. Means on the sleeve adjustably secure the same against vertical movement on the post in a vertical position determined by the extent to which the post projects into the water and into the floor of the water body. A clamping member is slightly secured to the sleeve and has a boat engaging portion extending over the inner edge of the boat. Cam means are located outwardly of the boat engaging portion of the clamping means and cooperate with the clamping member and the sleeve for moving the clamping member to draw such boat engaging portion against the inner side of the boat to claim the boat against the sleeve. The cam means are quickly releasable to permit the clamping member to be moved in a position in which the boat can be released from the clamping means.

U.S. Pat. No. 3,693,569 to L. Chauvin discloses a device and its method of use with small fishing, utility and pleasure boats to prevent their grounding on the water bottom or to protect their propulsion unit from contact therewith. This is accomplished by the present invention which comprises an adjustable shaft member fitted in a cooperating support assembly mounted on the boat. The elevation of the shaft is adjusted such that its end strikes the water bottom before the bottom of the boat or its propulsion unit does so.

U.S. Pat. No. 3,799,099 to H. Conover discloses a telescoping combination Boat Hook and Boat Pole and will lock in extended (or long) position or lock in closed (or short) position as need arises in handling of boat and where a boat hook or boat pole is needed for same.

U.S. Pat. No. 4,121,531 to D. Norton discloses a telescoping pole with a protruding-shaped foot arrangement at the forward end of its smaller diameter section. This section is provided with a sealed, flotation chamber. Protected alignment markers are provided on the smaller diameter section. The feet are provided with a device for catching a piling or the like from behind, for pulling a boat forwards and with a device for guiding the pole down a fishing line for freeing a snagged lure.

U.S. Pat. No. 6,145,717 to R. Rebeck discloses a holder for a push pole for maintaining a push pole within reach of a user includes a push pole holding portion and a mounting portion. The push pole holding portion is dimensioned to releasably hold the push pole. The mounting portion is configured to be positioned on the user's body.

U.S. Pat. No. 6,168,480 to R. Schaller discloses a push pole for propelling a boat comprising an elongated straight pole having a first and second end and a foot extending from the second end of the elongated pole. The foot consists of two prongs where the first prong extends coaxially in relation to the elongated pole and the second prong has an arcuate shape disposed towards the first prong. The first prongs has a spiraled configuration between a spade-like terminus and the elongated pole. The second prong has a spade-like terminus. The configuration of the foot provides for efficient insertion and release of the prongs from the floor of a waterway.

U.S. Pat. No. 6,220,197 to F. Pohlman discloses a device for operating and anchoring a watercraft in congested and hazardous water areas is provided with a spud assembly for easy operation. A pole is provided for moving a watercraft in shallow water. The pole functions through an operating cylinder connected to a maneuvering ring. The spud assembly has a locking device for locking the maneuvering ring and the operating cylinder against movement in order to anchor the watercraft with the pole.

U.S. Pat. No. 7,270,073 to D. Waldrop discloses an aesthetically pleasing anchor system designed to quickly anchor and release a boat in shallow water with minimal effort and little to no distraction from other activities such as fishing, which has an anchor sleeve containing a sleeve liner through which an anchor pole with a pointed bottom end passes through. The anchor pole extends below the hull of a boat into the lake or river bottom beneath, and which anchor pole can engage a locking insert when the anchor pole is twisted in either direction. The locking insert located in a notch cut out of the sleeve liner allows the anchor pole to be locked in a stowed position, and which has an upper flange which engages a hand grip wrapped around the top of the anchor pole, preventing the top end of the anchor pole from dropping completely through the boat hull, and which has a bottom flange attached to the boat hull bottom through which the anchor pole passes.

U.S. Pat. No. D519,820 to D. Newman et al. discloses an ornamental design for an extension pole, as shown and described.

Although some of the devices of the prior art have addressed these problems none has successfully solved the overall issue. Therefore it is an object of this invention to provide a mooring device which maintains the vessel in a stationary position within a body of water.

Another object of this invention is to provide a mooring device that may be promptly and simply installed and removed from the utility position.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a mooring device for securing a floating structure to a layer of soil. The layer of soil defines a soil floor that supports a body of water. The body of water defines a bottom edge adjacent to the soil floor and an upper edge. The upper edge of the body of water receives the floating structure. The body of water is displaced by the floating structure for providing a positive buoyancy to the floating structure. The floating structure supports an individual having a first hand and a second hand. The mooring device comprises a shaft extending between a first end and a second end. A point is secured to the first end of the shaft for permitting the shaft to transverse the soil floor and into the layer of soil.

A handle is secured to the second end of the shaft for receiving a descending vertical force or an ascending vertical force. The handle includes a concave upper surface extending between a primary end and a secondary end for receiving the first hand and/or the second hand of the individual during the descending vertical force. The handle includes a first convex surface and a second convex surface extending between an inner end to an exterior end for receiving the first hand and/or the second hand of the individual during the ascending vertical force. A first arc joins the primary end of the concave upper surface with the exterior end of the first convex surface for receiving the first hand and/or the second hand of the individual during either the descending vertical force or the ascending vertical force. A second arc joins the secondary end of the concave upper surface with the exterior end of the second convex surface for receiving the first hand and/or the second hand of the individual during either the descending vertical force or the ascending vertical force. A coupler joins the shaft to the floating structure.

In a more specific embodiment of the invention, the first end of the shaft includes a first diameter and the second end of the shaft includes a second diameter. The first diameter is less than the second diameter. A continuous taper extends between the first end and the second end for reducing the descending vertical force required for the shaft to transverse the soil floor and into the layer of soil.

In a more specific embodiment of the invention, a cylindrical grip defines a circular inside bore and a circular outside surface extending between a first end and a second end. The shaft traverses the circular inside bore of the cylindrical grip. The cylindrical grip is secured to the shaft for receiving either a second descending vertical force or a second ascending vertical force. The cylindrical grip includes a deformable material for receiving the first hand and/or the second hand of the individual during either the second descending vertical force or the second ascending vertical force.

In one embodiment of the invention, the coupler includes a cylindrical body and an anchor bracket. The cylindrical body includes a circular inside bore and a circular outside surface extending between a first end and a second end. The shaft slidably engaging the circular inside bore of the cylindrical body. The anchor bracket includes a mounting plate secured to the hull of the vessel and a joiner plate securing the cylindrical body to the anchor bracket.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
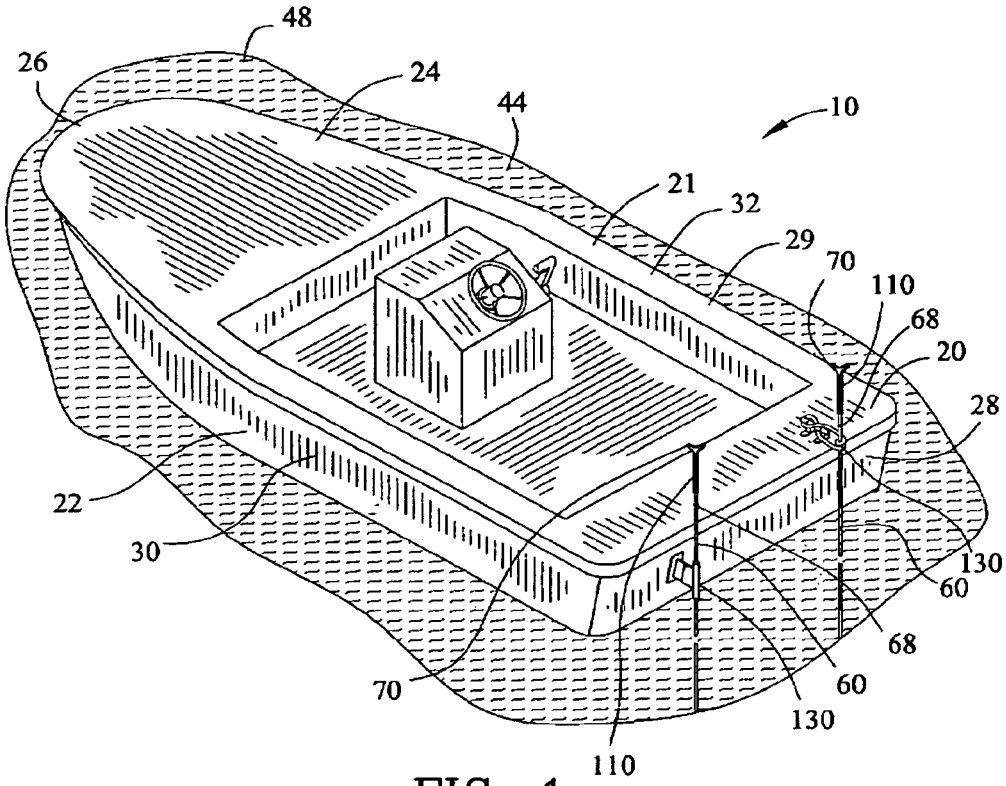
FIG. 1 is a top isometric view of a mooring device of the present invention for securing a floating structure to a layer of soil beneath a body of water.
Figure 2:
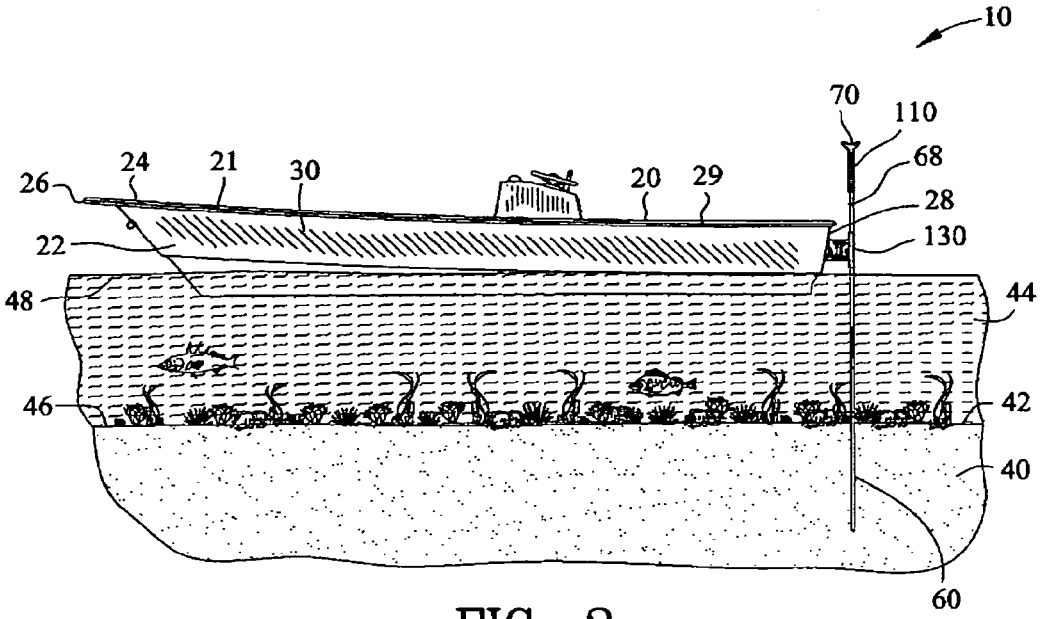
FIG. 2 is a side view of FIG. 1.
Figure 4:
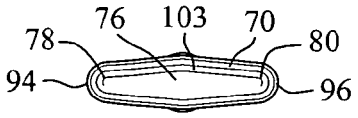
FIG. 4 is a top view of FIG. 3.
Figure 3:
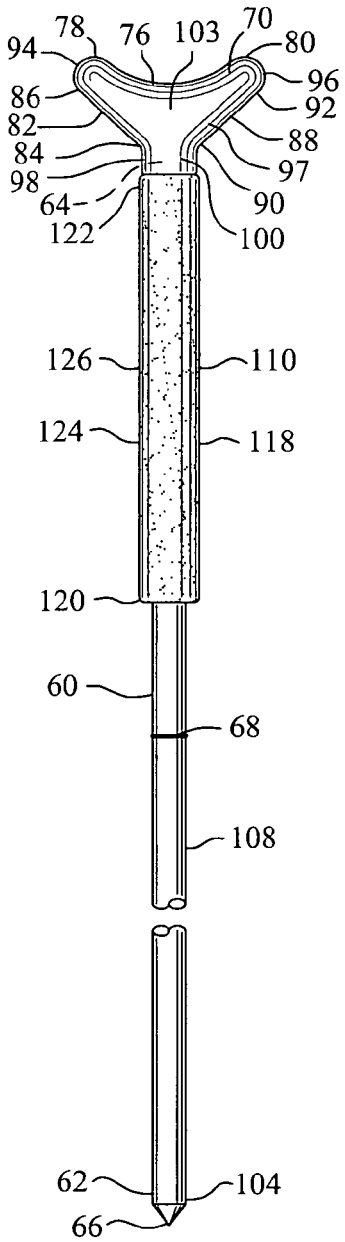
FIG. 3 is a front view of a shaft incorporating the present invention.
Figure 5:
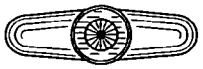
FIG. 5 is a bottom view of FIG. 3.
Figure 6:
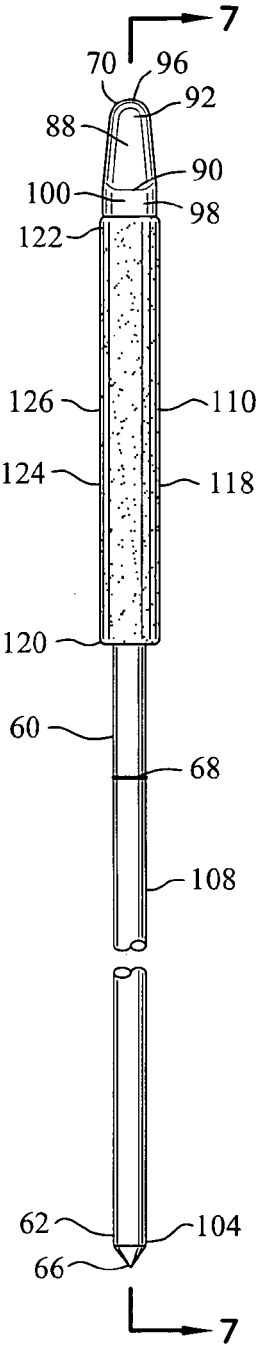
FIG. 6 is a right side view of FIG. 3.
Figure 7:
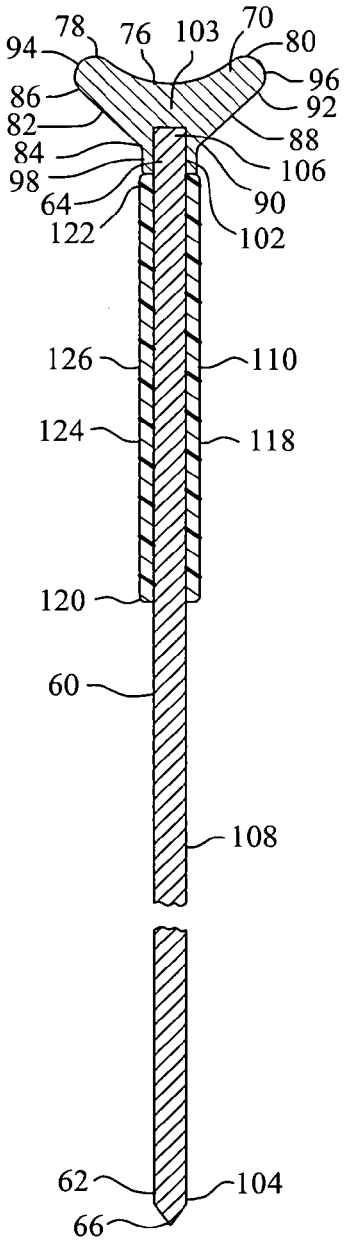
FIG. 7 is a sectional view along line 7-7 in FIG. 6.
Figure 8:
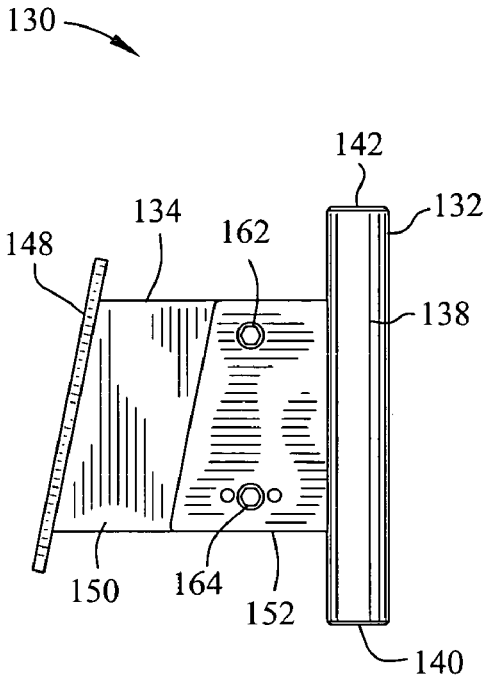
FIG. 8 is a left side view of a coupler incorporating the present invention.
Figure 9:
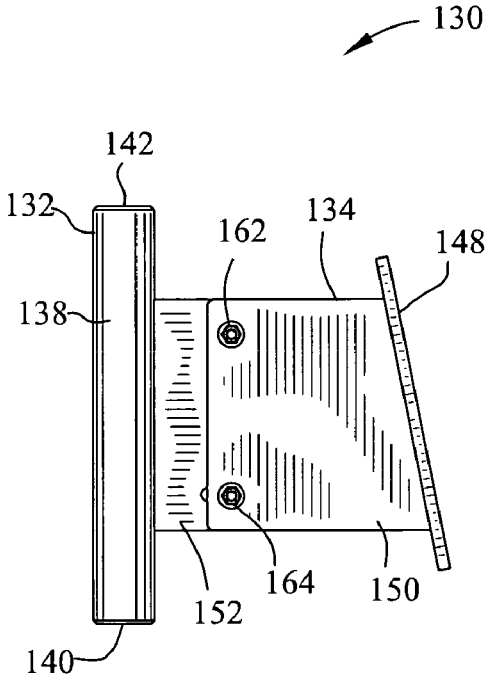
FIG. 9 is a right side view of FIG. 8.
Figure 10:
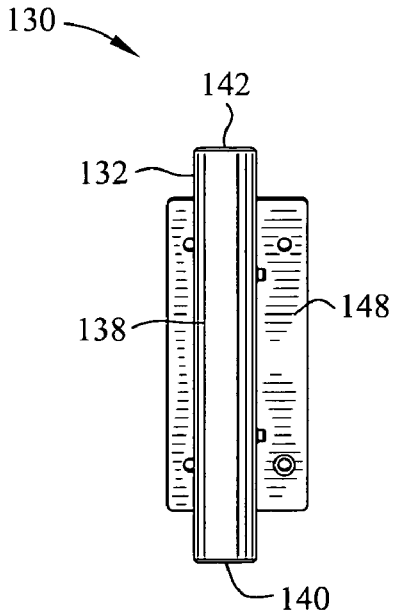
FIG. 10 is a front view of FIG. 8.
Figure 11:
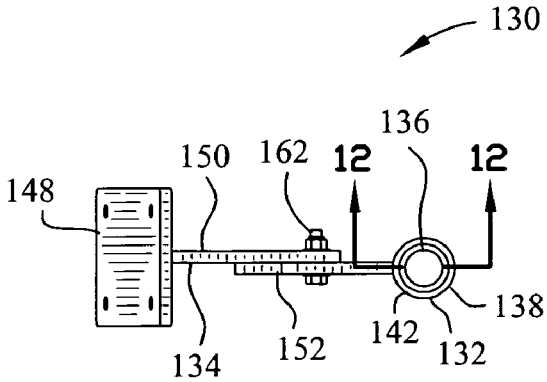
FIG. 11 is a top view of FIG. 8.
Figure 12:
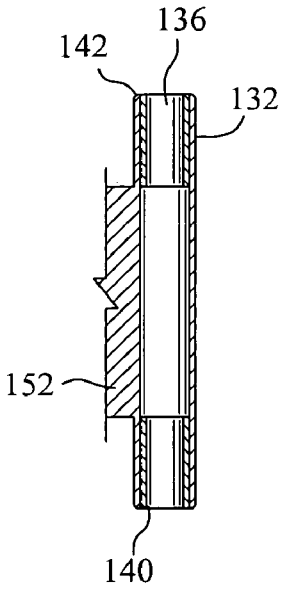
FIG. 12 is a sectional view along line 12-12 in FIG. 11.
Figure 13:
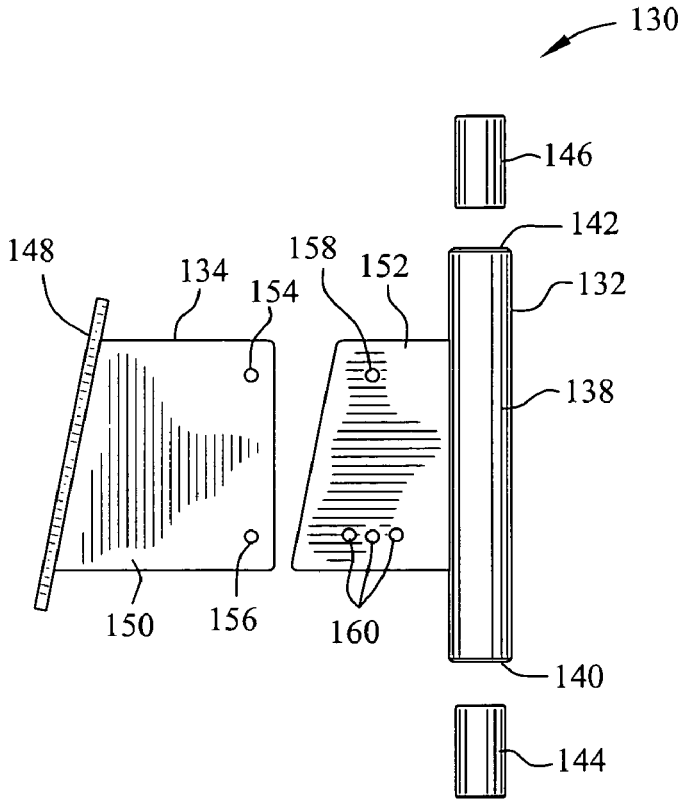
FIG. 13 is a an exploded view of FIG. 8.

FIGS. 1-21 are various views of a mooring device 10 for securing a floating structure 20 to a layer of soil 40. The layer of soil 40 defines a soil floor 42 that supports a body of water 44. The body of water 44 defines a bottom edge 46 adjacent to the soil floor 42 and an upper edge 48. The upper edge 48 of the body of water 44 receives the floating structure 20. The body of water 44 is displaced by the floating structure 20 for providing a positive buoyancy to the floating structure 20. Preferably, the mooring device 10 is utilized within relatively shallow water, such that the mooring device 10 may extend between the floating structure 20 and the soil floor 42.

The floating structure 20 may include a vessel 21 having a hull 22 and deck 24. The hull 22 defines a bow 26, a stern 28, a port side 30 and a starboard side 32. The vessel 21 may support an individual 12 having a first hand 14 and a second hand 16. FIGS. 1, 2, 16-22 illustrate the vessel 21 comprising a flats boat 29 however, the vessel 20 may comprise any other floating body.

As best seen in FIGS. 1-7 the mooring device 10 comprises a shaft 60. The shaft 60 extends between a first end 62 and a second end 64. The first end 62 of the shaft 60 includes a point 66 for permitting the shaft 60 to transverse the soil floor 42 and into the layer of soil 40. The shaft 60 may be constructed of polymeric, metallic, wood, fiber glass and resin or other rigid materials.

Figure 17:
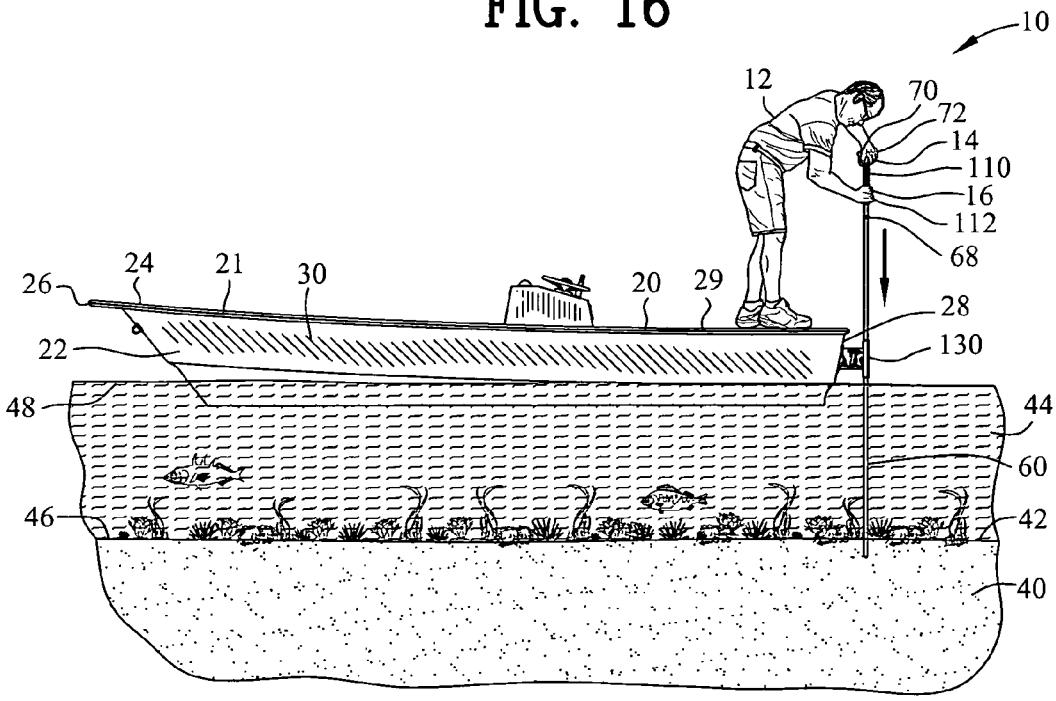
FIG. 17 is a view similar to FIG. 16 illustrating the shaft engaging the layer of soil.
Figure 20:
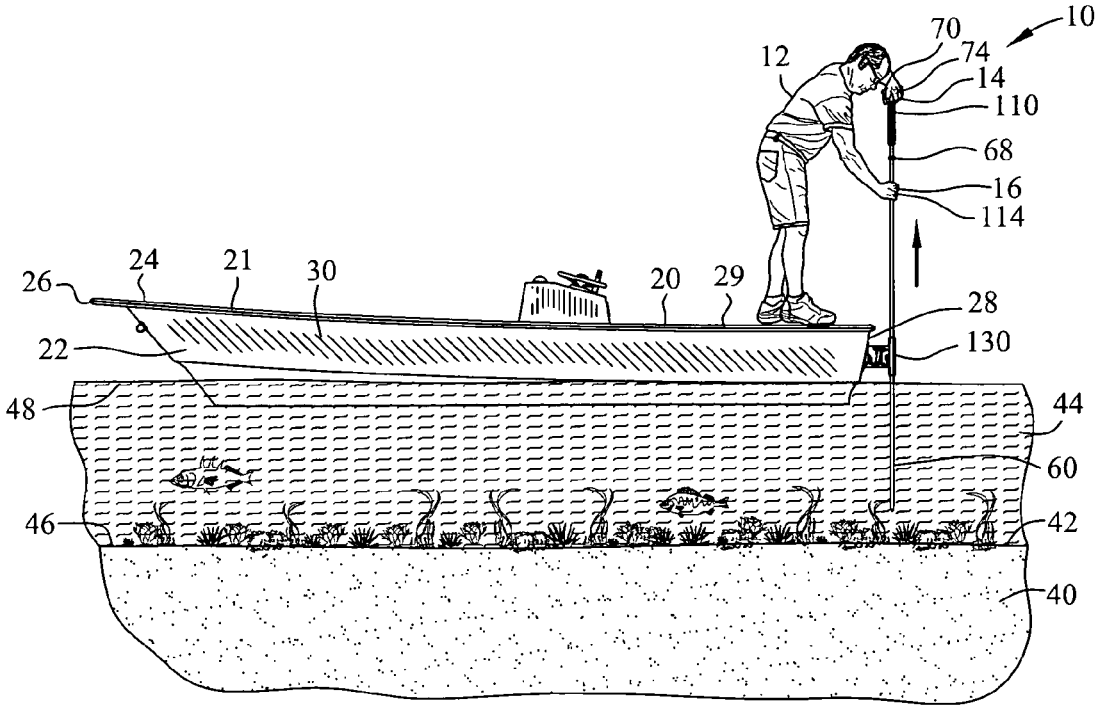
FIG. 20 is a view similar to FIG. 17 illustrating the shaft disengaging the layer of soil.

A handle 70 is secured to the second end 64 of the shaft 60 for receiving a descending vertical force 72 as seen FIG. 17 or an ascending vertical force 74 as seen in FIG. 20. The handle 70 includes a concave upper surface 76 extending between a primary end 78 and a secondary end 80 for receiving the first hand 14 and/or the second hand 16 of the individual 12 during the descending vertical force 72.

As best seen in FIGS. 4-7, the handle 70 further includes a first convex surface 82 extending between an inner end 84 to an exterior end 86, and a second convex surface 88 extending between an second inner end 90 to an second exterior end 92 for receiving the first hand 14 and/or the second hand 16 of the individual 12 during the ascending vertical force 74. A first arc 94 joins the primary end 78 of the concave upper surface 76 with the exterior end 86 of the first convex surface 82 for receiving the first hand 14 and/or the second hand 16 of the individual 12 during either the descending vertical force 72 or the ascending vertical force 74. A second arc 96 joins the secondary end 80 of the concave upper surface 76 with the exterior end 86 of the second convex surface 88 for receiving the first hand 14 and/or the second hand 16 of the individual 12 during either the descending vertical force 72 or the ascending vertical force 74. The concave upper surface 76, the first convex surface 82 and the second convex surface 88 define a generally crescent shape 97.

A barrel 98 may extend from the inner end 84 of the first convex surface 82 and the second inner end 90 of the second inner end 90. The barrel 98 defines an exterior barrel surface 100 and a barrel bore 102. The barrel bore 102 slidably receives the second end 64 of the shaft 60. Preferably, the concave upper surface 76, the first convex surface 82, the second convex surface 88, the first arc 94, the second arc 96, and the barrel 98 are constructed from an integral one piece unit 103. The integral one piece unit may be constructed from constructed of polymeric, metallic, wood, fiber glass and resin or other rigid materials. The barrel 98 may be secured to the shaft 60 by an adhesive, fastener traversing both the barrel 98 and the shaft 60 or other attachment devices.

The first end 62 of the shaft 60 may include a first diameter 104 and the second end 64 of the shaft 60 may include a second diameter 106. Preferably, the first diameter 104 is less than the second diameter 106. A continuous taper 108 extends between the first end 62 and the second end 64 for reducing the descending vertical force 72 required for the shaft 60 to transverse the soil floor 42 and into the layer of soil 40.

A cylindrical grip 110 may be fitted over the shaft 60 in order to facilitate the individual 12 to grasp the shaft 60 and provide either a second descending vertical force 112 or the second ascending vertical force 114. The cylindrical grip 110 defines a circular inside bore 116 and a circular outside surface 118 extending between a first end 120 and a second end 122. The shaft 60 traverses the circular inside bore 116 of the cylindrical grip 110. The cylindrical grip 110 is secured to the shaft 60 by an adhesive, fastener traversing both the cylindrical grip 110 and the shaft 60 or other attachment devices. The cylindrical grip 110 includes a deformable material 124 for receiving the first hand 14 and/or the second hand 16 of the individual 12 during either the second descending vertical force 112 or the second ascending vertical force 114. The deformable material 124 may be constructed of a foam 126. The second end 122 of the cylindrical grip 110 may be positioned adjacent to the barrel 98, however the second end 122 of the cylindrical grip 110 may be distanced from the barrel 98 for adjusting the location of the first hand 14 and/or the second hand 16 of the individual 12 relative to the shaft 60.

As best seen in FIGS. 1, 2, 8-21 a first coupler 130 joins the shaft 60 to the floating structure 20. The first coupler 130 includes a first cylindrical body 132 and a first anchor bracket 134. The cylindrical body 132 comprises a circular inside bore 136 and a circular outside surface 138 extending between a first end 140 and a second end 142. The first coupler 130 may be constructed from of a polymeric, metallic, fiber glass and resin or other rigid materials. The circular inside bore 136 of the first cylindrical body 132 may further include a first sleeve 144 and a second sleeve 146 positioned adjacent to the first end 140 and the second end 142 respectively. The first sleeve 144 and the second sleeve 146 may be secured by a pressing fit, an adhesive, a fastener or other attachment devices. The first sleeve 144 and the second sleeve 146 may be constructed from of a polymeric, metallic, fiber glass and resin or other rigid materials. The shaft 60 slidably engages within the first sleeve 144 and the second sleeve 146 for displacing the shaft 60 within the circular inside bore 136 of the first cylindrical body 132.

The first anchor bracket 134 includes a mounting plate 148 secured to the hull 22 of the vessel 21 and a first joiner plate 150 and a second joiner plate 152 pivotably securing the cylindrical body 132 to the first anchor bracket 134. The first joiner plate 150 extends from the mounting plate 148. The mounting plate 148 may include a first pivot aperture 154 and a first angle aperture 156. The second joiner plate 152 extends from the cylindrical body 132. The second joiner plate 152 includes a second pivot aperture 158 and a plurality of angle locking apertures 160. The first joiner plate 150 and the second pivot aperture 152 may be constructed from of a polymeric, metallic, fiber glass and resin or other rigid materials.

A pivot fastener 162 traverses the first pivot aperture 154 and the second pivot aperture 158 to pivot the cylindrical body 132 relative to the first anchor bracket 134. The pivot fastener 162 is shown as a bolt and nut, however may include other fasteners.

A lock fastener 164 traverses the first angle aperture 156 and one of the plurality of angle locking apertures 160. By positioning the lock fastener 164 in alternate Plurality of angle locking apertures 160, the angle between the cylindrical body 132 relative to the first anchor bracket 134 may be altered. The lock fastener 164 is shown as a bolt and nut, however may include other fasteners.

Figure 14:
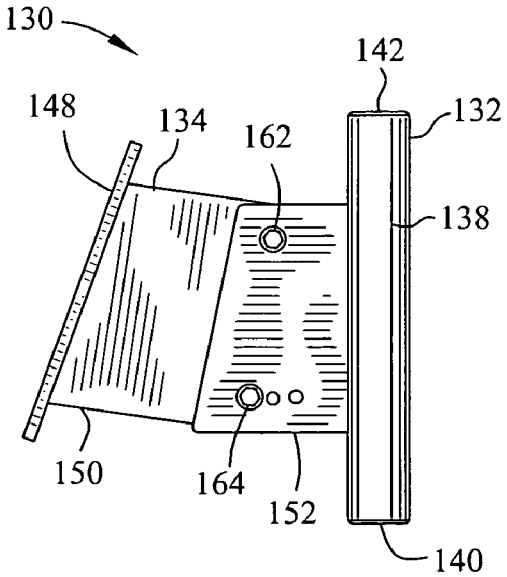
FIG. 14 is a view similar to FIG. 8 illustrating the coupler having a first angle.
Figure 15:
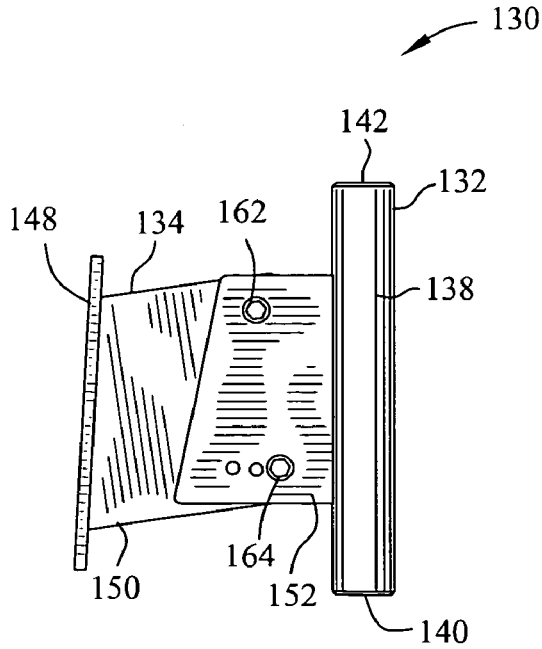
FIG. 15 is a view similar to FIG. 14 illustrating the coupler having a second angle.

As best seen in FIGS. 14 and 15, the first coupler 130 is allowed to pivot in order to adjust the relative angle between the cylindrical body 132 and the first anchor bracket 134. Preferably, the cylindrical body 132 should be positioned in a vertical orientation in order to slidably engage the shaft 60 also in a vertical orientation. However, the hull 22 of the vessel 21 may be sloped relative to the vertical orientation. As a result, if the first coupler 130 were not permitted to pivot, the cylindrical body 132 would also be sloped relative to the vertical orientation. FIG. 14 illustrates an orientation of the first anchor bracket 134 to be utilized on a raked aft transom 34. In FIG. 14 the raked aft transom 34 is angled, however, the cylindrical body 132 has a vertical orientation. FIG. 15 illustrates an orientation of the first anchor bracket 134 to be utilized on a raked forward transom 36. In FIG. 15 raked forward transom 36 is angled in the opposite direction, however, the cylindrical body 132 also has a vertical orientation.

The first coupler 130 may alternatively include a rope encircling the shaft 60 and impressing the shaft 60 against the hull 22. The ends of the rope would then be secured to either a cleat or other secure point within the vessel 21.

Figure 16:
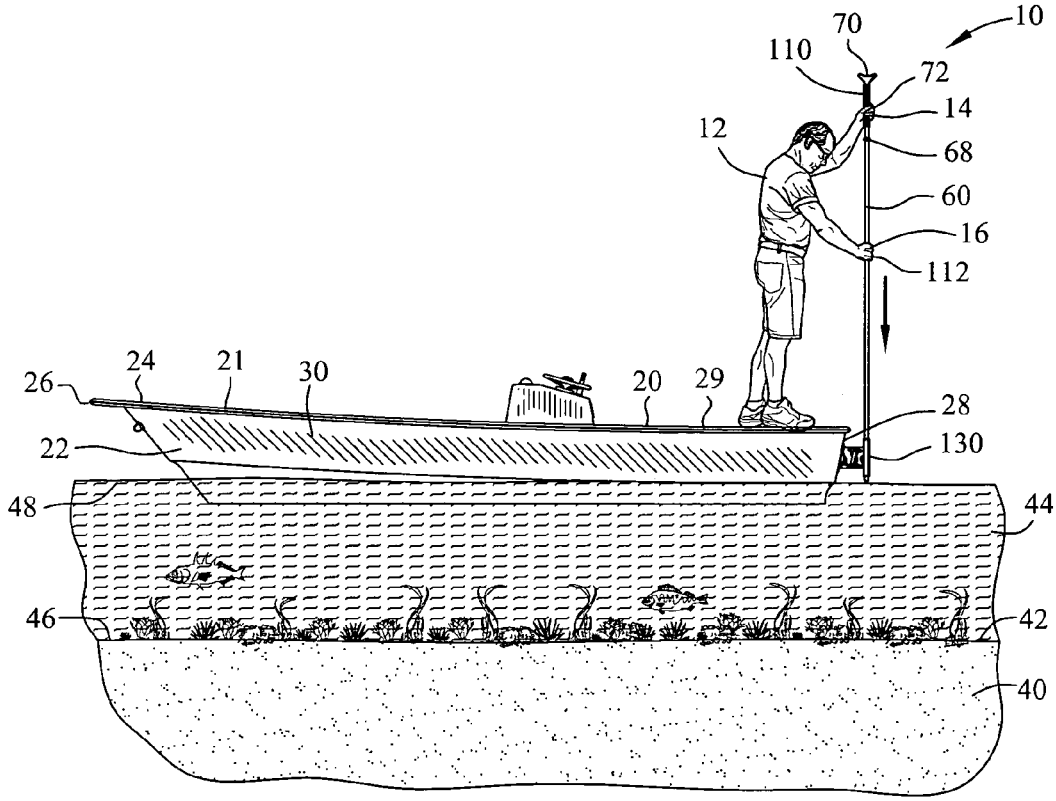
FIG. 16 is a view similar to FIG. 2 illustrating the shaft inserted into the coupler.

FIGS. 16 and 17 illustrate the mooring device 10 being implemented in order to retain the vessel 21 at a fixed location. In order to utilize the mooring device 10, the first end 62 of the shaft 60 is slidably inserted into the first cylindrical body 132. The individual 12 applies a descending vertical force 72 until the first end 62 of the shaft 60 has been embedded into the layer of soil 40. Since the shaft 60 is permitted to freely rotate within the first cylindrical body 132, the vessel is permitted to rotate about the shaft 60 three hundred and sixty (360) degrees, thereby removing any torsional force on either the shaft 60 and/or the first coupler 130.

To apply the descending vertical force 72 the individual 12 may position the first hand 14 and/or the second hand 16 on the handle 70 and/or the cylindrical grip 110 for applying a descending vertical for 72. More specifically, either the first hand 14 and/or the second hand 16 may be positioned on the concave upper surface 76. Alternatively, the first hand 14 and the second hand 16 may both be positioned on the concave upper surface 76 such that the first hand 14 engages around the primary and 78 and the first convex surface 82 and the second hand 16 engages around the secondary and 80 and the second convex surface 88. Alternatively, the first hand 14 and the secondary hand 16 may be positioned on the handle, while the non-elected hand 14 or 16 is positioned around the cylindrical grip 110.

Figure 18:
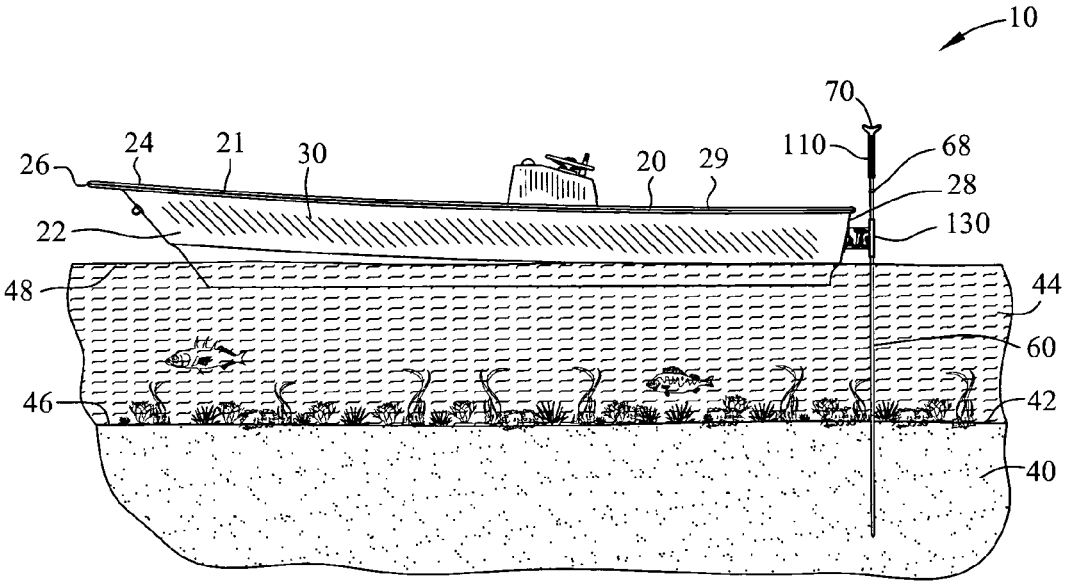
FIG. 18 is a view similar to FIG. 2 illustrating the body of water having a first depth.
Figure 19:
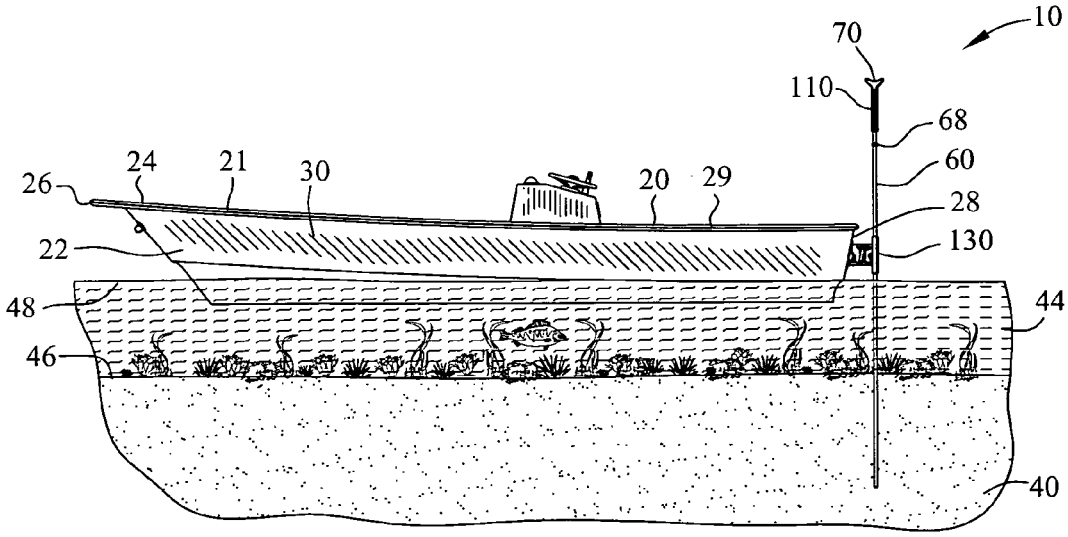
FIG. 19 is a view similar to FIG. 18 illustrating the body of water having a second depth.

FIGS. 18 and 19 illustrate the mooring device 10 being utilized, wherein there is a change in water depth. Since the shaft 60 is freely slidable within the first cylindrical body 132, if there is a change in the water depth, the shaft 60 is permitted to slide within the first cylindrical body 132 in order to relieve moment forces on either the shaft 60 and/or the first coupler 130. The shaft 60 may include a marker 68 for referencing the position of the shaft 60 relative to the coupler 130. As illustrated in FIG. 18, the marker 68 is positioned adjacent to the coupler 130. As seen in FIG. 19, the depth of the water has been reduced. As such the shaft 60 ascends within the cylindrical body 132. As the shaft 60 ascends relative to the cylindrical body 132, the marker 68 also ascends in the same proportion to the reduction of the depth of the water. Similarly, as the shaft 60 descends relative to the cylindrical body 132, the marker 68 also descends in the same proportion to the increase in the depth of the water. As such, the marker 68 will provide the individual 12 with a reference to any variations in the depth of the water.

Figure 21:
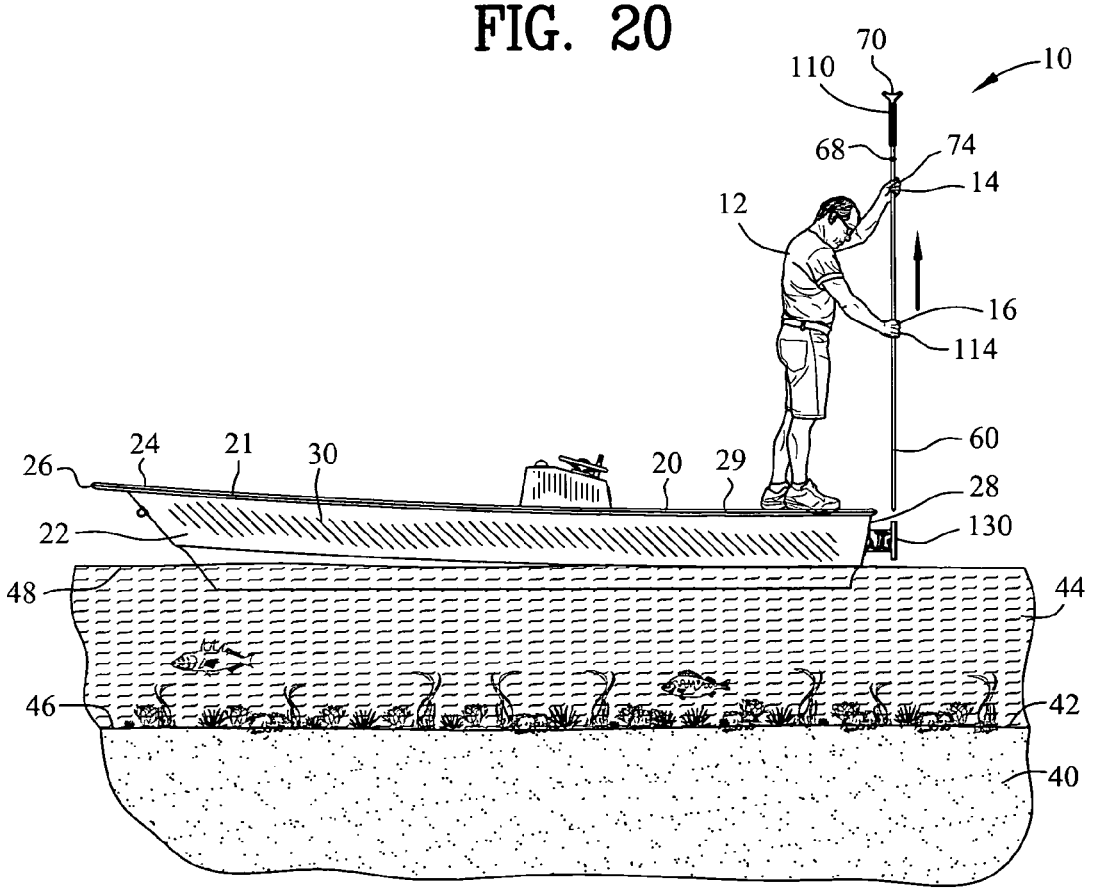
FIG. 21 is a view similar to FIG. 16 illustrating the shaft disengaging the coupler.
Figure 22:
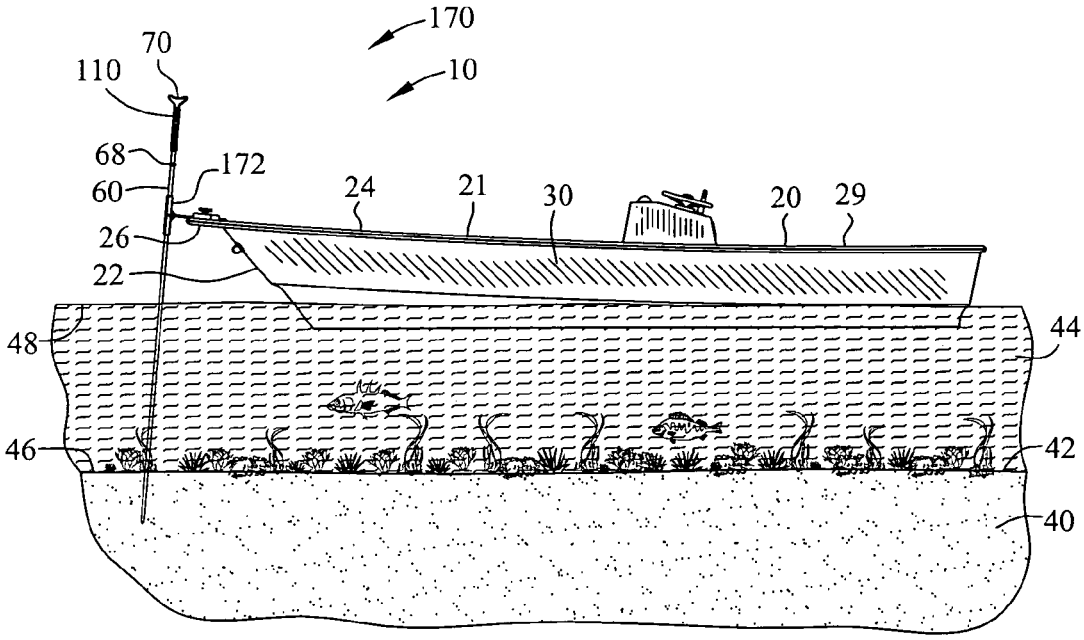
FIG. 22 is a view similar to FIG. 2 illustrating an anchor bracket secured to the floating structure.
Figure 23:
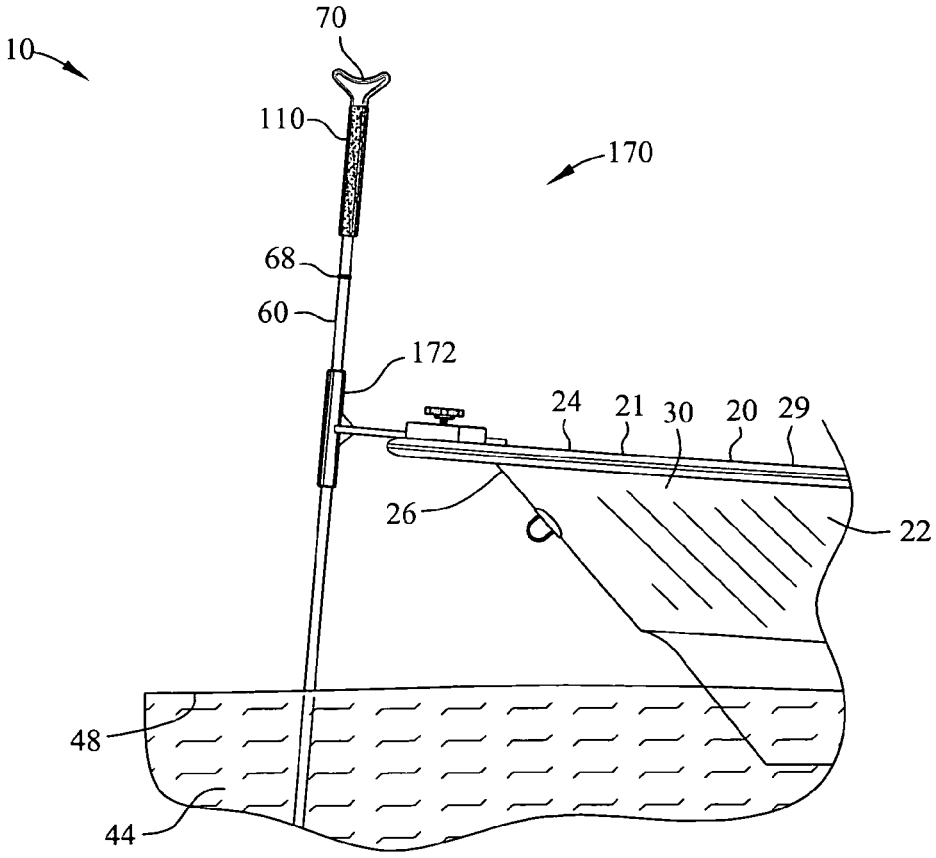
FIG. 23 is an enlarged portion of FIG. 22.
Figure 24:
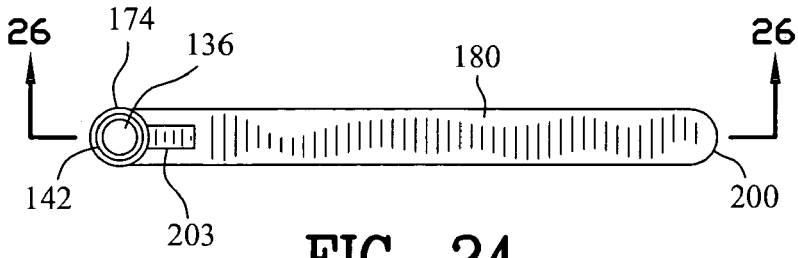
FIG. 24 is a top view of the cylindrical body and an anchor bracket of FIG. 23.
Figure 25:
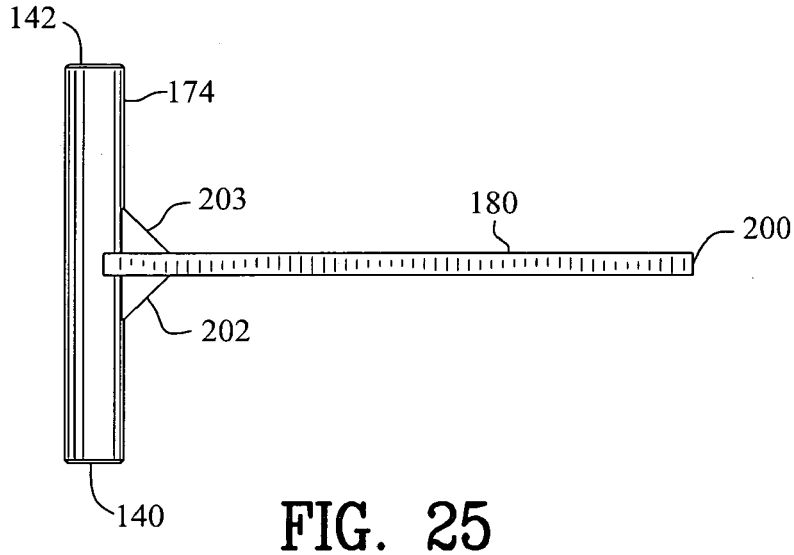
FIG. 25 is a side view of FIG. 24.
Figure 26:
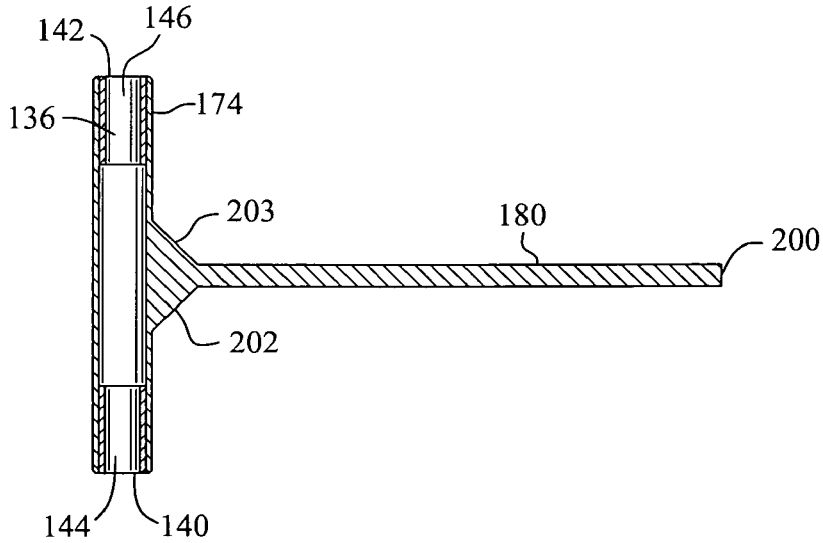
FIG. 26 is a sectional view along line 26-26 in FIG. 24.
Figure 27:
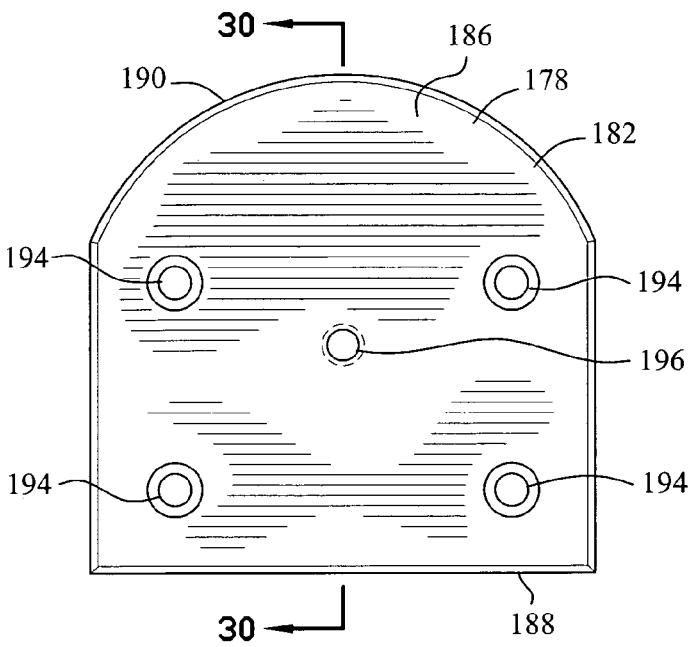
FIG. 27 is a top view of a key receiver of FIG. 23.
Figure 30:
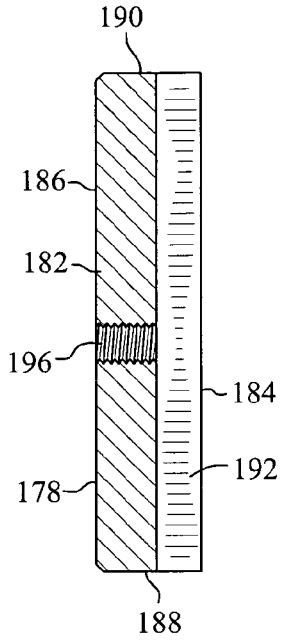
FIG. 30 is a sectional view along line 30-30 in FIG. 27.
Figure 28:
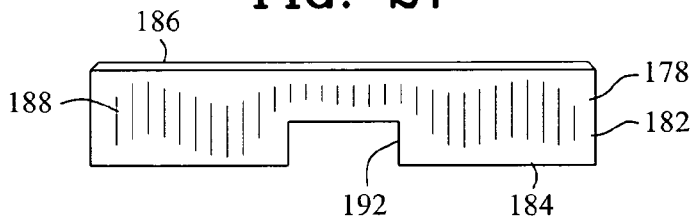
FIG. 28 is a front view of FIG. 27.
Figure 29:
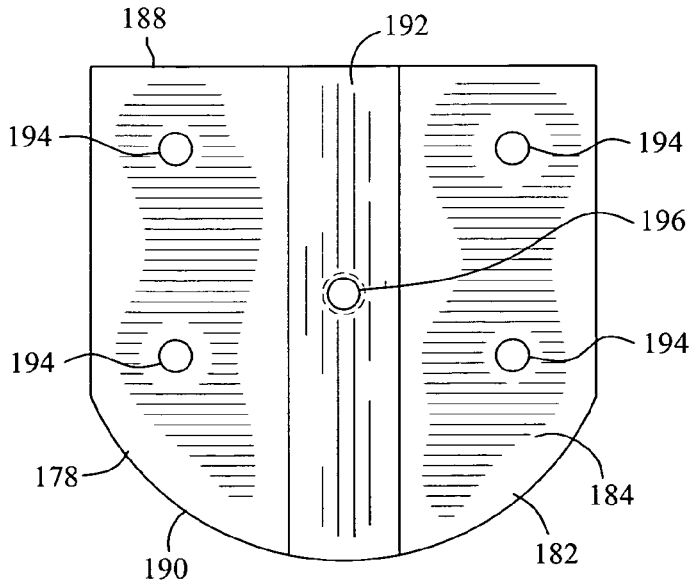
FIG. 29 is a bottom view of FIG. 27.
Figure 31:
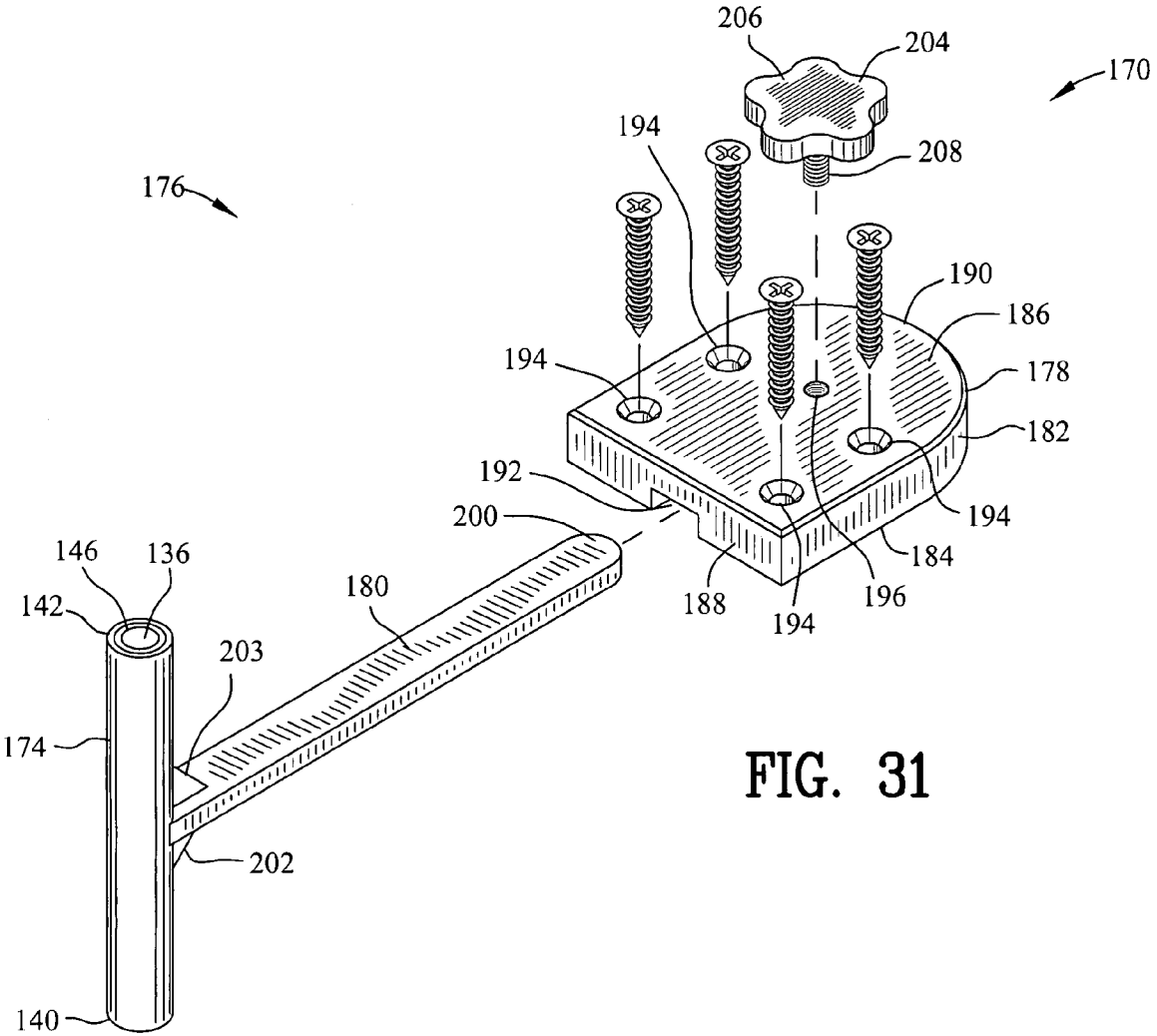
FIG. 31 is a front isometric view of the cylindrical body and the anchor bracket of FIG. 23.

FIGS. 20 and 21 illustrate the mooring device 10 being removed from the layer of soil 40 in order to release the vessel 21 at the fixed location. In order to remove the mooring device 10, the ascending vertical force 74 is applied to the shaft 60. The shaft 60 in turn slidably engages the cylindrical body 132 until the first end 62 of the shaft 60 clears the cylindrical body 132.

To apply the ascending vertical force 74 the individual 12 may position the first hand 14 and/or the second hand 16 on the handle 70 and/or the cylindrical grip 110 for applying the ascending vertical for 74. More specifically, either the first hand 14 and/or the second hand 16 may be positioned on both of the first convex surface 82 and second convex surface 88. Alternatively, the first hand 14 may be positioned on the first convex surface 82 and the second hand 16 may be positioned on the second convex surface 88. Alternatively, the first hand 14 and the secondary hand 16 may be positioned on the handle, while the non-elected hand 14 or 16 is positioned around the cylindrical grip 110.

FIGS. 22-31 illustrate a second embodiment 170 of the subject invention wherein a second coupler 172 joins the shaft 60 to the floating structure 20. The second coupler 172 includes a second cylindrical body 174 and a second anchor bracket 176. The second cylindrical body 174 comprises a circular inside bore 136 and a circular outside surface 138 extending between a first end 140 and a second end 142. The second coupler 172 may be constructed from of a polymeric, metallic, fiber glass and resin or other rigid materials. The circular inside bore 136 of the second cylindrical body 174 may further include a first sleeve 144 and a second sleeve 146 positioned adjacent to the first end 140 and the second end 142 respectively. The first sleeve 144 and the second sleeve 146 may be secured by a pressing fit, an adhesive, a fastener or other attachment devices. The first sleeve 144 and the second sleeve 146 may be constructed from of a polymeric, metallic, fiber glass and resin or other rigid materials. The shaft 60 slidably engages within the first sleeve 144 and the second sleeve 146 for displacing the shaft 60 within the circular inside bore 136 of the second cylindrical body 174.

The second anchor bracket 176 includes a key receiver 178 secured to the deck 24 of the floating structure 20 and a key plate 180 extending from the second cylindrical body 174. The second anchor bracket 176 may be constructed from of a polymeric, metallic, fiber glass and resin or other rigid materials.

The key receiver 178 defines a base 182 having a bottom surface 184, a top surface 186, a front surface 188 and a rear arcuate surface 190. The base 182 includes a groove 192 extends from the bottom surface 184 and between the front surface 188 and the rear arcuate surface 190. A plurality of bores 194 traverse the base 182 for receiving a fastener. The fasteners engage the deck 24 for securing the base 182 to the floating structure 20. The base 182 further includes a threadable bore 196 traversing into the groove 192.

The second anchor bracket 176 further includes a key plate 180 slidably engaging within the groove 192 of the key receiver 178 for adjusting the distance between the second cylindrical body 174 and the deck 24. The key plate 180 may include a key arcuate end 200 for assisting in the insertion key plate 180 into the groove 192. The key plate 180 may further include a first reinforcing rib 202 and a second reinforcing rib 203 extending between the key plate 180 and the second cylindrical body 174. The first reinforcing rib 202 and the second reinforcing rib 203 prevent yielding of the key plate 180 relative to the second cylindrical body 174.

A pin 204 having a knob portion 206 and a threaded portion 208 threadably engages the threaded bore 196 of the key receiver 178 for locking the key plate 180 within the key receiver 178.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A mooring device for securing a floating structure to a layer of soil, the layer of soil defining a soil floor that supports a body of water, the body of water defining a bottom edge adjacent to the soil floor and an upper edge, the upper edge of the body of water receiving the floating structure, the body of water displaced by the floating structure for providing a positive buoyancy to the floating structure, the floating structure supporting an individual having a first hand and a second hand, the mooring device, comprising:

a shaft extending between a first end and a second end;

a point securing to said first end of said shaft for permitting said shaft to transverse the soil floor and into the layer of soil;

a handle securing to said second end of said shaft for receiving a descending vertical force or an ascending vertical force;

said handle including an upper surface extending between a primary end and a secondary end for receiving the first hand of the individual during said descending vertical force;

said handle including a first surface and a second surface extending between an inner end to an exterior end for receiving the first hand and/or the second hand of the individual during said ascending vertical force;

a first joiner joining said primary end of said upper surface with said exterior end of said first surface for receiving the first hand and/or the second hand of the individual during either said descending vertical force or said ascending vertical force; and a second joiner joining said secondary end of said upper surface with said exterior end of said second surface for receiving the first hand and/or the second hand of the individual during either said descending vertical force or said ascending vertical force; and a coupler including a rope encircling said shaft and impressing said shaft against the floating structure.

2. A mooring device for securing a floating structure to a layer of soil, the layer of soil defining a soil floor that supports a body of water, the body of water defining a bottom edge adjacent to the soil floor and an upper edge, the upper edge of the body of water receiving the floating structure, the body of water displaced by the floating structure for providing a positive buoyancy to the floating structure, the floating structure supporting an individual having a first hand and a second hand, the mooring device, comprising:

a shaft extending between a first end and a second end;

a point securing to said first end of said shaft for permitting said shaft to transverse the soil floor and into the layer of soil;

a handle securing to said second end of said shaft for receiving a descending vertical force or an ascending vertical force;

said handle including an upper surface extending between a primary end and a secondary end for receiving the first hand of the individual during said descending vertical force;

said handle including a first surface and a second surface extending between an inner end to an exterior end for receiving the first hand and/or the second hand of the individual during said ascending vertical force;

a first joiner joining said primary end of said upper surface with said exterior end of said first surface for receiving the first hand and/or the second hand of the individual during either said descending vertical force or said ascending vertical force; and a second joiner joining said secondary end of said upper surface with said exterior end of said second surface for receiving the first hand and/or the second hand of the individual during either said descending vertical force or said ascending vertical force;

a coupler joining said shaft to the floating structure;

said upper surface includes a concave upper surface extending between a primary end and a secondary end for receiving the first hand of the individual during said descending vertical force;

said first surface includes a first convex surface and said second surface includes a second convex surface extending between an inner end to an exterior end for receiving the first hand and/or the second hand of the individual during said ascending vertical force;

said first joiner includes a first arc joining said primary end of said concave upper surface with said exterior end of said first convex surface for receiving the first hand and/or the second hand of the individual during either said descending vertical force or said ascending vertical force;

said second joiner includes a second arc joining said secondary end of said concave upper surface with said exterior end of said second convex surface for receiving the first hand and/or the second hand of the individual during either said descending vertical force or said ascending vertical force;

said first end of said shaft includes a first diameter and said second end of said shaft includes a second diameter;

said first diameter being less than said second diameter; and a continuous taper extending between said first end and said second end for reducing the descending vertical force required for said shaft to transverse the soil floor and into the layer of soil.

3. A mooring device for securing a floating structure to a layer of soil, the layer of soil defining a soil floor that supports a body of water, the body of water defining a bottom edge adjacent to the soil floor and an upper edge, the upper edge of the body of water receiving the floating structure, the body of water displaced by the floating structure for providing a positive buoyancy to the floating structure, the floating structure supporting an individual having a first hand and a second hand, the mooring device, comprising:

a shaft extending between a first end and a second end;

a point securing to said first end of said shaft for permitting said shaft to transverse the soil floor and into the layer of soil;

a handle securing to said second end of said shaft for receiving a descending vertical force or an ascending vertical force;

said handle including an upper surface extending between a primary end and a secondary end for receiving the first hand of the individual during said descending vertical force;

said handle including a first surface and a second surface extending between an inner end to an exterior end for receiving the first hand and/or the second hand of the individual during said ascending vertical force;

a first joiner joining said primary end of said upper surface with said exterior end of said first surface for receiving the first hand and/or the second hand of the individual during either said descending vertical force or said ascending vertical force; and a second joiner joining said secondary end of said upper surface with said exterior end of said second surface for receiving the first hand and/or the second hand of the individual during either said descending vertical force or said ascending vertical force;

a coupler joining said shaft to the floating structure;

a cylindrical grip defining a circular inside bore and a circular outside surface extending between a first end and a second end;

said shaft traversing said circular inside bore of said cylindrical grip;

said cylindrical grip secured to said shaft for receiving either a second descending vertical force or a second ascending vertical force; and said cylindrical grip including a deformable material for receiving the first hand and/or the second hand of the individual during either said second descending vertical force or said second ascending vertical force.

4. A mooring device for securing a floating structure to a layer of soil, the layer of soil defining a soil floor that supports a body of water, the body of water defining a bottom edge adjacent to the soil floor and an upper edge, the upper edge of the body of water receiving the floating structure, the body of water displaced by the floating structure for providing a positive buoyancy to the floating structure, the floating structure supporting an individual having a first hand and a second hand, the mooring device, comprising:

a shaft extending between a first end and a second end;

a point securing to said first end of said shaft for permitting said shaft to transverse the soil floor and into the layer of soil;

a handle securing to said second end of said shaft for receiving a descending vertical force or an ascending vertical force;

said handle including an upper surface extending between a primary end and a secondary end for receiving the first hand of the individual during said descending vertical force;

said handle including a first surface and a second surface extending between an inner end to an exterior end for receiving the first hand and/or the second hand of the individual during said ascending vertical force;

a first joiner joining said primary end of said upper surface with said exterior end of said first surface for receiving the first hand and/or the second hand of the individual during either said descending vertical force or said ascending vertical force; and a second joiner joining said secondary end of said upper surface with said exterior end of said second surface for receiving the first hand and/or the second hand of the individual during either said descending vertical force or said ascending vertical force;

a coupler joining said shaft to the floating structure; and said shaft includes a marker for referencing the position of said shaft relative to said coupler.

5. A mooring device for securing a floating structure to a layer of soil, the layer of soil defining a soil floor that supports a body of water, the body of water defining a bottom edge adjacent to the soil floor and an upper edge, the upper edge of the body of water receiving the floating structure, the body of water displaced by the floating structure for providing a positive buoyancy to the floating structure, the floating structure supporting an individual having a first hand and a second hand, the mooring device, comprising:

a shaft extending between a first end and a second end;

a point securing to said first end of said shaft for permitting said shaft to transverse the soil floor and into the layer of soil;

a handle securing to said second end of said shaft for receiving a descending vertical force or an ascending vertical force;

said handle including an upper surface extending between a primary end and a secondary end for receiving the first hand of the individual during said descending vertical force;

said handle including a first surface and a second surface extending between an inner end to an exterior end for receiving the first hand and/or the second hand of the individual during said ascending vertical force;

a first joiner joining said primary end of said upper surface with said exterior end of said first surface for receiving the first hand and/or the second hand of the individual during either said descending vertical force or said ascending vertical force; and a second joiner joining said secondary end of said upper surface with said exterior end of said second surface for receiving the first hand and/or the second hand of the individual during either said descending vertical force or said ascending vertical force;

a coupler joining said shaft to the floating structure;

said coupler includes a cylindrical body and an anchor bracket;

said cylindrical body including a circular inside bore and a circular outside surface extending between a first end and a second end;

said shaft slidably engaging said circular inside bore of said cylindrical body; and said anchor bracket including a mounting plate secured to the floating structure and a joiner plate securing said cylindrical body to said anchor bracket.

6. A mooring device for securing a vessel to a layer of soil as set forth in claim 5, wherein said circular inside bore of said cylindrical body having a first sleeve positioned adjacent to said first end of said cylindrical body and a second sleeve positioned adjacent to said second end of said cylindrical body for slidably engaging said shaft with said circular inside bore of said cylindrical body.

7. A mooring device for securing a vessel to a layer of soil as set forth in claim 5, wherein said joiner plate including a first joiner plate and a second joiner plate pivotably securing said cylindrical body to said anchor bracket;

said first joiner plate extending from said mounting plate and including a first pivot aperture and an first angle aperture;

said second joiner plate extending from said cylindrical body and including a second pivot aperture and a plurality of angle locking apertures;

a pivot fastener traversing said first pivot aperture and said second pivot aperture for pivoting said cylindrical body relative to said anchor bracket; and a lock fastener traversing said first angle aperture and one of said plurality of angle locking apertures for setting an angle between said cylindrical body relative to said anchor bracket.

8. A mooring device for securing a floating structure to a layer of soil, the layer of soil defining a soil floor that supports a body of water, the body of water defining a bottom edge adjacent to the soil floor and an upper edge, the upper edge of the body of water receiving the floating structure, the body of water displaced by the floating structure for providing a positive buoyancy to the floating structure, the floating structure supporting an individual having a first hand and a second hand, the mooring device, comprising:

a shaft extending between a first end and a second end;

a point securing to said first end of said shaft for permitting said shaft to transverse the soil floor and into the layer of soil;

a handle securing to said second end of said shaft for receiving a descending vertical force or an ascending vertical force;

said handle including an upper surface extending between a primary end and a secondary end for receiving the first hand of the individual during said descending vertical force;

said handle including a first surface and a second surface extending between an inner end to an exterior end for receiving the first hand and/or the second hand of the individual during said ascending vertical force;

a first joiner joining said primary end of said upper surface with said exterior end of said first surface for receiving the first hand and/or the second hand of the individual during either said descending vertical force or said ascending vertical force; and a second joiner joining said secondary end of said upper surface with said exterior end of said second surface for receiving the first hand and/or the second hand of the individual during either said descending vertical force or said ascending vertical force;

a coupler joining said shaft to the floating structure;

said coupler includes a cylindrical body and an anchor bracket;

said cylindrical body including a circular inside bore and a circular outside surface extending between a first end and a second end;

said shaft slidably engaging said circular inside bore of said cylindrical body;

said anchor bracket including a key receiver secured to the deck of the floating structure and a key plate extending from said cylindrical body;

said key plate slidably engaging within said key receiver for adjusting the distance between the cylindrical body and the deck; and a pin threadably engaging said key receiver for locking said key plate within said key receiver.

9. A mooring device for securing a vessel to a layer of soil, the layer of soil defining a soil floor that supports a body of water, the body of water defining a bottom edge adjacent to the soil floor and an upper edge, the upper edge of the body of water receiving the vessel, the body of water displaced by the vessel for providing a positive buoyancy to the vessel, the vessel including a hull and deck, the hull defining a bow, a stern, a port side and a starboard side, the vessel supporting an individual having a first hand and a second hand, the mooring device, comprising:

a shaft extending between a first end and a second end;

a point securing to said first end of said shaft for permitting said shaft to transverse the soil floor and into the layer of soil;

a handle securing to said second end of said shaft for receiving a descending vertical force or an ascending vertical force;

said handle including a concave upper surface extending between a primary end and a secondary end for receiving the first hand and/or the second hand of the individual during said descending vertical force;

said handle including a first convex surface and a second convex surface extending between an inner end to an exterior end for receiving the first hand and/or the second hand of the individual during said ascending vertical force;

a first arc joining said primary end of said concave upper surface with said exterior end of said first convex surface for receiving the first hand and/or the second hand of the individual during either said descending vertical force or said ascending vertical force; and a second arc joining said secondary end of said concave upper surface with said exterior end of said second convex surface for receiving the first hand and/or the second hand of the individual during either said descending vertical force or said ascending vertical force;

a coupler joining said shaft to the vessel;

a cylindrical grip defining a circular inside bore and a circular outside surface extending between a first end and a second end;

said shaft traversing said circular inside bore of said cylindrical grip;

said cylindrical grip secured to said shaft for receiving either a second descending vertical force or a second ascending vertical force; and said cylindrical grip including a deformable material for receiving the first hand and/or the second hand of the individual during either said second descending vertical force or said second ascending vertical force.

10. A mooring device for securing a vessel to a layer of soil, the layer of soil defining a soil floor that supports a body of water, the body of water defining a bottom edge adjacent to the soil floor and an upper edge, the upper edge of the body of water receiving the vessel, the body of water displaced by the vessel for providing a positive buoyancy to the vessel, the vessel including a hull and deck, the hull defining a bow, a stern, a port side and a starboard side, the vessel supporting an individual having a first hand and a second hand, the mooring device, comprising:

a shaft extending between a first end and a second end;

a point securing to said first end of said shaft for permitting said shaft to transverse the soil floor and into the layer of soil;

a handle securing to said second end of said shaft for receiving a descending vertical force or an ascending vertical force;

said handle including a concave upper surface extending between a primary end and a secondary end for receiving the first hand of the individual during said descending vertical force;

said handle including a first convex surface and a second convex surface extending between an inner end to an exterior end for receiving the first hand and/or the second hand of the individual during said ascending vertical force;

a first arc joining said primary end of said concave upper surface with said exterior end of said first convex surface for receiving the first hand and/or the second hand of the individual during either said descending vertical force or said ascending vertical force; and a second arc joining said secondary end of said concave upper surface with said exterior end of said second convex surface for receiving the first hand and/or the second hand of the individual during either said descending vertical force or said ascending vertical force;

a coupler including a cylindrical body and an anchor bracket;

said cylindrical body including a circular inside bore and a circular outside surface extending between a first end and a second end;

said shaft slidably engaging said circular inside bore of said cylindrical body; and said anchor bracket including a mounting plate secured to the hull of the vessel and a joiner plate securing said cylindrical body to said anchor bracket.

* * * * *